United States Patent [19]

Dürr et al.

[11] Patent Number: 4,475,826

[45] Date of Patent: Oct. 9, 1984

[54] MATRIX PRINTER WITH MAGNETIC HEAD ADJUSTMENT

[75] Inventors: Heinrich Dürr, Wilnsdorf; Lothar Haubrich; Wendelin Weber, both of Siegen; Hermann Richter, Freudenberg, all of Fed. Rep. of Germany

[73] Assignee: U.S. Philips Corporation, New York, N.Y.

[21] Appl. No.: 467,574

[22] Filed: Feb. 17, 1983

Related U.S. Application Data

[63] Continuation of Ser. No. 266,571, May 22, 1981, abandoned.

[30] Foreign Application Priority Data

May 23, 1980 [DE] Fed. Rep. of Germany ..... 3019773

[51] Int. Cl.³ ..... B41J 3/12

[52] U.S. Cl. ..... 400/124; 101/93.05; 400/352

[58] Field of Search ..... 400/121, 124, 320, 352, 400/354; 101/93.04, 93.05

[56] References Cited

U.S. PATENT DOCUMENTS 4,010,835 3/1977 Martin et al. ..... 400/124

4,031,992 6/1977 Murat et al. ..... 400/124

FOREIGN PATENT DOCUMENTS 2459254 7/1975 Fed. Rep. of Germany ..... 400/124

*Primary Examiner*—Paul T. Sewell

*Attorney, Agent, or Firm*—Robert S. Smith

[57] ABSTRACT

A matrix printer comprising a printing head which is pivotable, under the influence of the braking effect of a magnetic field, about an axis which is perpendicular to the line direction and to the surface of the paper to be printed. The different printing positions of the printing head realized by said pivoting motion are utilized for printing characters with a comparatively good recognizability at a comparatively low printing speed or, as desired, for printing characters which are less rapidly recognizable at a comparatively high printing speed.

Matrix printers of this kind are used, for example, in text editing systems.

5 Claims, 3 Drawing Figures

MATRIX PRINTER WITH MAGNETIC HEAD ADJUSTMENT

This is a continuation of application Ser. No. 266,571, filed May 22, 1981, abandoned.

BACKGROUND OF THE INVENTION

1. Field of the Invention

The invention relates to a matrix printer having a carriage which is movable to and fro along a paper guide and on which there is arranged a printing head having different printing positions for which purpose it is relatively pivotable with respect to the carriage about an axis which extends perpendicularly to the line direction and also perpendicularly to the surface of the paper to be printed, the relative pivoting motion of the printing head with respect to the carriage being realized by means of a magnetically activatable position changer which exerts a torque on the printing head.

2. Description of the Prior Art

In a known matrix printer of the kind set forth (U.S. Pat. No. 4,031,992) the position changer consists of an arm which is connected to the printing head near one end and which comprises on its other end a knob which is movable by means of an electromagnetic drive. The electromagnetic drive may be indirect by means of an adjustable toothed segment which does not move to and fro with the carriage and which engages the knob near the reversing point of the carriage, or direct by connection of the armature of an electromagnet mounted on the carriage to the knob. It is a drawback of the indirect drive that via the arm a substantial impact force is exerted on the printing hand by the toothed segment when the toothed segment is approached at a comparatively high speed by the knob. If the toothed segment is approached at a comparatively low speed in order to prevent an excessive impact force, the printing speed will be adversely affected. The direct drive has the drawback that in the case of a comparatively fast printing head adjustment, the impact forces on the vulnerable armature of the electromagnet have to be taken into account. A comparatively slow printing head adjustment adversely affects the printing speed again. The fixed connection between the armature and the printing head renders the construction susceptible to dimensional deviations of the parts.

It is to be noted that U.S. Pat. No. 4,010,835 describes a matrix printing head where one part of a two-part printing head is displaced with respect to another part of the printing head by means of an electromagnet which is mounted on the carriage which is movable to and fro. Thus, this printing head is not a printing head which is pivotable in its entirety. The two-part printing head is comparatively expensive, because both parts have to be guided and supported. U.S. Pat. No. 4,010,835 also describes a printing head which is pivotable in its entirety. It is not disclosed how the pivoting motion is realized.

SUMMARY OF THE INVENTION

It is an object of the invention to provide a matrix printer of the kind set forth which substantially reduces the risk of undesirably large impact forces with a comparatively fast printing head adjustment.

To this end, a matrix printer in accordance with the invention is characterized in that the position changer is pivotable by the braking effect of a magnetic field.

Because the coupling between the position changer and a part of the braking device is realized by a magnetic field and the force exerted by this field for the displacement of the position changer has to be only small, the risk of unacceptably high impact forces on the printing head is minimized. This is the case even if the pivoting of the position changer takes place at a high carriage speed, because the magnetic field also performs the function of a slip coupling.

A special embodiment of a matrix printer in accordance with the invention in which a comparatively small mass must be accelerated and decelerated is characterized in that the magnetic field is produced by a stationary electromagnet which cooperates with a strip-shaped slide of a magnetically conductive material which is displaceable parallel to the line direction with respect to the carriage and the position changer journalled in the carriage, the position changer and the slide being coupled to one another by means of a pin/slot joint in order to obtain a pivoting motion of the position changer about an axis which extends parallel to the pivot axis of the printing head.

Another special embodiment is characterized in that the pivot axis of the printing as well as the pivot axis of the position changer is situated underneath the printing head, the position changer comprising two pressure members which are situated one on each side of the plane through the two pivot axes and which are alternatively in pressure/sliding contact with a flat portion of the printing head. It is an advantage of such an embodiment that the space above and adjacent the printing head is not occupied by structural members for exerting the torque on the printing head. Consequently, said space can be utilized to accommodate other parts of the printer, such as the ribbon cassette, ribbon guides etc.

Another embodiment yet of the matrix printer is characterized in that the carriage and the slide are connected to one another by means of a dead center spring which has a first stable position which corresponds to a first printing position of the printing head and a second stable position which corresponds to a second printing position of the printing head. The dead center spring simply and inexpensively ensures that the mutual positions of the position changer and the slide which correspond to the first and the second printing positions remain stable also in the case of vibrations.

BRIEF DESCRIPTION OF THE DRAWINGS

The invention will be described in detail hereinafter with reference to the drawing, in which.

DESCRIPTION OF THE PREFERRED EMBODIMENT

Figure 1:
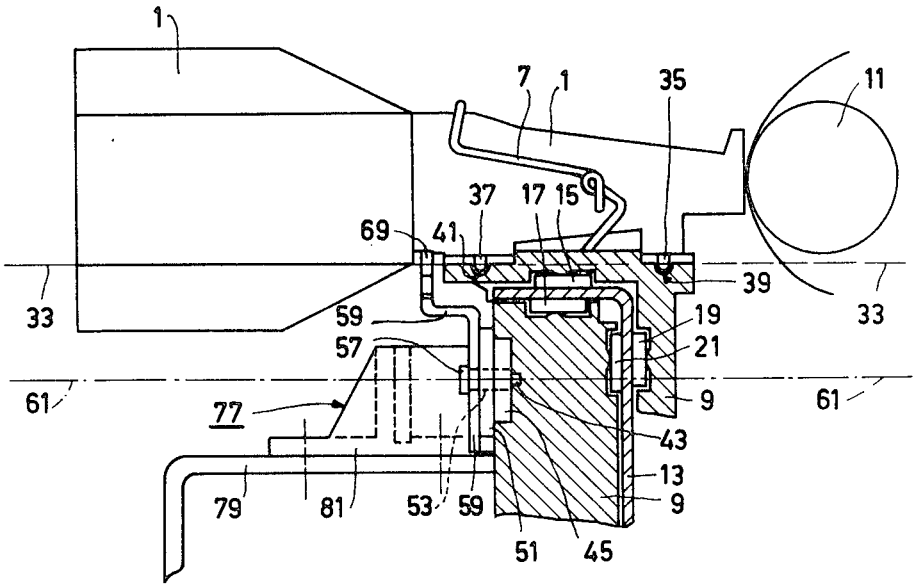
FIG. 1 is a partial side elevation and a partial sectional view of a matrix printer in accordance with the invention.
Figure 2:
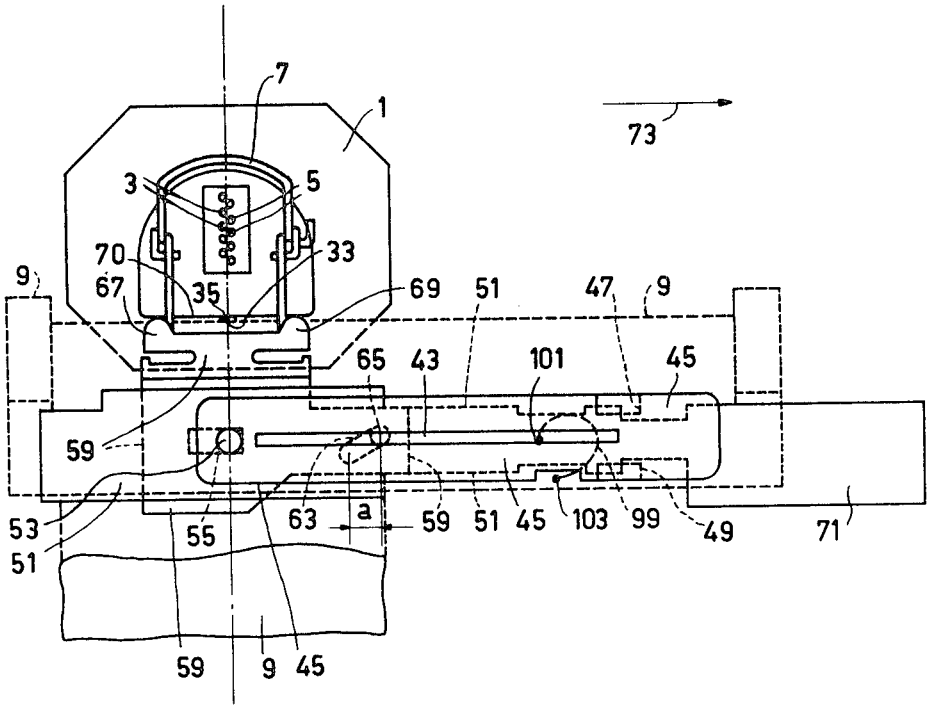
FIG. 2 is a front view of a part of the matrix printer shown in FIG. 1.
Figure 3:
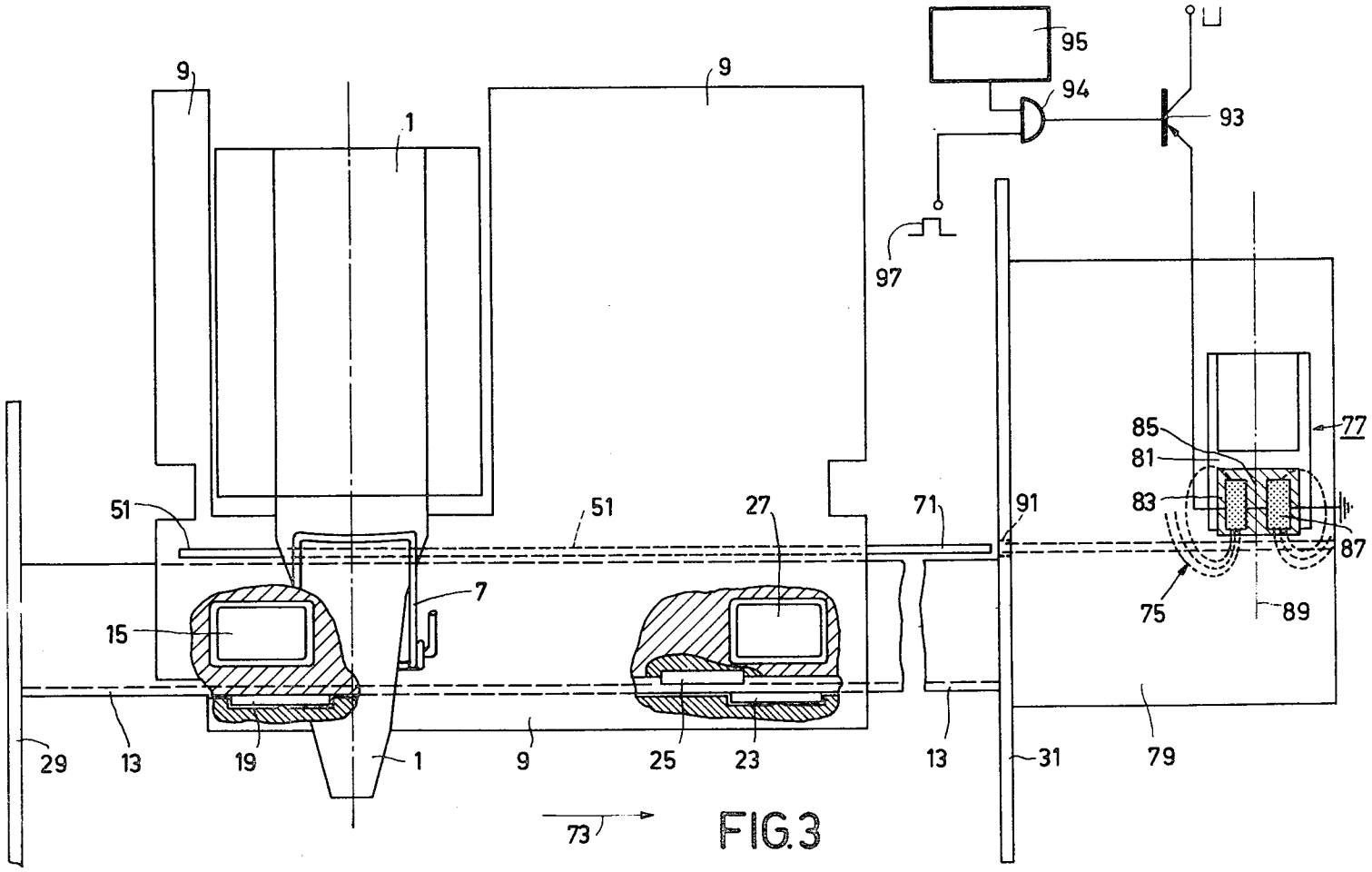
FIG. 3 is a plan view of the matrix printer shown in FIG. 1.

The matrix printer shown in the FIGS. 1, 2 and 3 comprises a printing head 1 of a type which is suitable for so-called matrix printing. In the present case printing is realized by means of electromagnetically driven printing styli, the printing ends 3 and 5 of which are situated in two mutually staggered columns. The distance between two successive printing ends is the same in both columns. In the position of the printing head which is shown in FIG. 2, the two columns of printing ends are in a vertical position. The printing ends 5 in the right column have been staggered with respect to the printing ends 3 of the left column over a distance which is equal to half the distance between two successive printing ends in one and the same column. The printing head 1 is connected to a carriage 9 by means of a wire clamp 7. The fixation of a printing head to a carriage by means of such a wire clamp is known. The carriage 9 is movable to and fro along a paper guide 11 (FIG. 1) in the line direction by displacement on a guide profile 13. In order to minimize the friction between the carriage 9 and the guide profile 13, use is made of sliding plates 15, 17, 19, 21, 23, 25 and 27 (see FIGS. 1 and 3). The guide profile 13 is connected to two side plates 29 and 31 which form part of the frame of the matrix printer (see FIG. 3).

The printing head 1 is pivotable with respect to the carriage 9 about an axis 33 which extends perpendicularly to the line direction and also perpendicularly to the surface to be printed. To this end, the printing head 1 comprises two supporting pins 35 and 37, the rounded ends of which bear in round sockets 39 and 41, respectively, in the carriage 9. The pivot axis 33 extends through the supporting pins 35 and 37. A strip-shaped guide 45 is journalled in the guide profile 13 by means of a rib 43 (see FIGS. 1 and 2), said guide 45 being connected to the carriage 9 (not shown) and, therefore, moving with the carriage 9 in the line direction (parallel to the rib 43). A strip-shaped slide 51 is guided in the strip-shaped guide 45 by means of protrusions 47 and 49. The protrusions 47 and 49 engage around the upper and the lower side, respectively, of the slide 51. A trunnion 53 which projects through a window 55 of the slide 51 is journalled in the strip-shaped guide 45. The trunnion 53 comprises a head 57 (see FIG. 1). Between the head 57 and the strip-shaped slide 51 there is located a position changer 59 which is pivotable about the trunnion 53. The center line of the trunnion 53 is denoted by the reference numeral 61 in FIG. 1, so it actually represents the pivot axis of the position changer 59. The slide 51 comprises a slot 63 which serves as a slotted hole for a pin 65. The slot 63 is situated in a vertical plane and encloses an acute angle with a horizontal plane. The pin 65 forms part of the position changer 59 (see FIG. 2). The horizontal component (viewed in the line direction) of the distance which can be travelled by the pin 65 in the slot 63 is indicated by the references a in FIG. 2. The position changer 59 comprises two pressure members in the form of cams 67 and 69 which bear against the partly flat lower side 70 of the printing head 1 in a pressure/sliding contact therewith. In the position of the position changer 59 which is shown in FIG. 2, the cams 67 and 69 are symmetrically situated with respect to the axis 33, while the pin 65 is situated in the extreme top right corner of the slot 63.

The slide 51 comprises a widened portion in the form of a flap 71 which, after the carriage 9 has been displaced to the right in the direction of the arrow 73 over a given distance, enters the field 75 of an excited electromagnet. The slide 51 is made of a magnetically conductive material. The electromagnetic 77 is mounted on a base 79 which is connected to the side plate 31 and comprises a frame 81 which comprises an E-shaped yoke 83 with a core 85 around which an excitation coil 87 is provided. The center line 89 of the excitation coil 87 extends perpendicularly to the plane of the flap 71. In the side plate 31 there is provided an opening 91 where-through the slide 51 can pass. The electromagnet 77 is excited by connecting the excitation coil 87 to an electric voltage U. This is realized via a switching transistor 93, the base of which is connected to a logic AND-gate 94 which comprises two inputs. One input of the logic AND-gate is connected to an electronic control circuit 95 of the matrix printer which supplies a signal having the value "1" when the movement of the carriage 9 is reversed, while the other input of the logic AND-gate is connected to an external signal generator which supplies a pulse 97 having the value "1" when the printing head 1 has to be pivoted about the axis 33 after the reversal of the movement. Pivoting of the printing head 1 about the axis 33 is realized as follows.

At the instant at which the movement of the carriage 9 to the right in a direction of the arrow 73 has been decelerated to zero and an acceleration of the carriage to the left commences, the electronic control circuit 95 generates a signal having the value "1" on one input of the logic AND-gate 94. If the printing head has to be pivoted due to a desired high printing speed, an external generator applies a pulse 97 of the value "1" to the other input of the logic AND-gate 94. The output of the logic AND-gate 94 then supplies an electric voltage of such a value to the base of the switching transistor 93 that the switching transistor 93 becomes conductive, so that the excitation coil 87 is connected to the voltage U for the duration of the pulse 97. At the instant at which the excitation coil 87 is excited, the flap 71 is situated within the field 75 and is retained therein for a brief period of time after the reversal of the movement of the carriage 9 and during the acceleration of the carriage 9 to the left. The duration of the pulse 97 is such that the pin 65 which moves with the carriage 9 travels a distance a in the horizontal direction with respect to the slot 63 which is present in the side 51 retained in the magnetic field 75. As if it were, the field 75 exerts a braking effect on the slide 51. Due to the displacement of the pin 65 in the slot 63 which extends at an angle with respect to the line direction, the position changer 59 pivots about the trunnion 53 or the pivot axis 61 so that a pressure is exerted on the printing head 1 at the area of the cam 69. Consequently, the printing head 1 pivots through a given angle about the axis 33 which is determined by the contacting of the pin 65 at the bottom left in the slot 63. The carriage 9 also comprises an abutment face for the printing head 1 which is not visible in the figures. The pin 65 is retained at the bottom left in the slot 63 by means of a wire spring 99, one end 101 of which is connected to the slide 51 while its other end 103 is connected to the carriage 9. Under the influence of the wire spring 99 which acts as a dead center spring, the pin 65 is biased against the left end of the slot 63. The wire spring 99 is then in a first stable position. The wire spring 99 prevents undesirable relative movement between the pin 65 and the slot 63 in the case of vibrations. The pulse 97, and hence also the excitation of the electromagnet 77, is terminated at the instant at which the pin 65 abuts against the left end of the slot 63, or briefly thereafter. The force exerted by the magnetic field 75 on the flap 71 of the slide 51 is never so large that an excessive duration of the pulse 97 could damage the pin 65. This is because the field 75 acts as a slip coupling on the slide 51. In the matrix printer shown, the printing head 1 is not pivoted after the reversal of the movement of the carriage 9 at the left end of the printed line. It is only when the carriage 9 moves in the direction of the arrow 73 again and the flap 71 approaches the electromagnet 77 that, if desirable, pivoting of the printing head 1 can be initiated again by magnetic braking of the slide 51. Assume that pivoting is again necessary; in that case it is necessary to excite the coil 87 at an instant so long before the reversal of the movement of the carriage 9 (from right to left) that the pin 65 can be displaced over a distance a in the horizontal direction with respect to the slide 63 before the movement reversal commences. At the area of the cam 67 a pressure is then exerted on the printing head 1 which produces a torque which opposes the torque previously exerted on the printing head 1 by the cam 69. In the matrix printer shown, the distance between the pivot axes 33 and 61 equals 20 mm. The center-to-center distance between the printing ends 3 or 5 of one and the same column is 0.36 mm while the center-to-center distance between the two columns of printing ends amounts to 2.117 mm.

Before the first movement reversal of the carriage 9 at the right end of the printed line took place, the two columns of printing hands were in a mutually staggered position (viewed in the vertical direction). In this staggered position, characters can be printed with a maximum of ten printed dots in the vertical part of a character. The vertical distance between the printed dots, therefore, is comparatively small, that is to say 0.18 mm. After the first movement reversal of the carriage 9, the printing head 1 was pivoted through an angle of approximately 5°. The corresponding printing ends 3 and 5 of the two columns are then at about the same level, viewed vertically. The vertical distance between the printed dots is then 0.36 mm. Even though in the case of such a vertical distance (0.36 mm) the recognizability of a printed character is less than the recognizability in the case of a vertical distance of 0.18 mm, it is an advantage that printing can take place with a comparatively higher printing speed. This is possible by alternatively using both columns of printing ends, viewed in the horizontal direction.

The invention is not restricted to embodiments of matrix printers where the printing head can be pivoted only upon movement reversal at the right side. For example, by constructing the slide 51 to be symmetrical with a flap 71 on each end and by providing an electromagnet also at the left side, the printing head can be pivoted upon each movement reversal. Furthermore, use can be made of an electromagnet which moves with the carriage 9 in combination with a stationary strip of a magnetically conductive material which extends along the entire path of the carriage 9. This has the drawback that the moving mass is increased, but the advantage that pivoting of the printing head is possible anywhere along the movement path. Instead of an electromagnet, use can alternatively be made of a permanent magnet. This permanent magnet may be stationary as well as movable with the carriage 9. The magnetic braking effect can also be exerted directly on the position changer 59 without utilizing a slide 51. The position changer 59 is then at least partly made of a magnetically conductive material.

The invention is not restricted either to matrix printers comprising printing heads in which the printing elements are formed by electromagnetically driven printing styli. Actually, any type of printing head which is suitable for matrix printing can be used, for example, a printing head in which ink droplets are formed which are applied to the paper via tubes. It is also to be noted that when use is made of a printing hand comprising only one column of printing elements, the printing elements can be printed at a first level during a first pass of the printing head and at a second level during a second pass afgter pivoting of the printing head through, for example, 10° in order to complete the characters already partly printed during the first pass.

Finally, it is to be noted that the pivoting of the printing head through approximately 5° does not produce characters which resemble italics. Moreover, the inclination of the vertical parts of a character can be eliminated by means of electronic delay circuits, for example, as described in U.S. Pat. No. 4,031,992.

What is claimed is:

1. An improved matrix printer having a carriage which is movable to and fro along a paper guide and on which there is arranged a printing head having different printing positions for which purpose it is relatively pivotable with respect to the carriage about an axis which extends perpendicularly to the line direction and also perpendicularly to the surface of the paper to be printed, the relative pivoting motion of the printing head with respect to the carriage being realized by means of a magnetically activatable position changer which exerts a torque on the printing head, wherein the improvement comprises:

said printer further includes means to pivot the position changer utilizing the braking effect of a magnetic field to change the position of the position changer responsive to movement of the carriage.

2. A matrix printer as claimed in claim 1, characterized in that the magnetic field is produced by a stationary electromagnet which cooperates with a strip-shaped slide of a magnetically conductive material which is displaceable parallel to the line direction with respect to the carriage and the position changer journalled in the carriage, the position changer and the slide being coupled to one another by means of a pin slot joint in order to obtain a pivoting motion of the position changer about an axis which extends parallel to the pivot axis of the printing head.

3. A matrix printer as claimed in claim 2, characterized in that the pivot axis of the printing head as well as the pivot axis of the position changer is situated underneath the printing head, the position changer comprising two pressure members which are situated one on each side of the plane through the two pivot axes and which are alternately in pressure/sliding contact with a flat portion of the printing head.

4. A matrix printer as claimed in claim 2, characterized in that the carriage and the slide are connected to one another by means of a dead center spring which has a first stable position which corresponds to a first printing position of the printing head and a second stable position which corresponds to a second printing position of the printing head.

5. A matrix printer as claimed in claim 1, characterized in that the printing head comprises two columns of printing elements which are staggered with respect to each other and whose printing ends are situated at the same distance from a plane perpendicular to the line direction which extends through the pivot axis of printing head in one of the printing positions of the printing head.

* * * * *